United States Patent [19]

Roop et al.

[11] 4,116,016

[45] Sep. 26, 1978

[54] CORROSION-RESISTANT LIQUIFIED GAS EVAPORATOR

[75] Inventors: Robert Roop, Doylestown; Carl Shine, Philadelphia, both of Pa.

[73] Assignee: Fischer & Porter Co., Warminster, Pa.

[21] Appl. No.: 775,524

[22] Filed: Mar. 8, 1977

[51] Int. Cl.[2] ..... F17C 7/02

[52] U.S. Cl. ..... 62/52; 122/33; 122/DIG. 13; 165/133; 165/134 R; 165/DIG. 8; 138/DIG. 3

[58] Field of Search ..... 165/133, 134, DIG. 8; 122/33, DIG. 13; 62/50, 51, 52, 53; 126/360 R; 138/DIG. 3

[56] References Cited

U.S. PATENT DOCUMENTS

| | | | |
|---|---|---|---|
| 2,724,672 | 11/1955 | Rubin | 138/DIG. 3 |
| 3,050,786 | 8/1962 | St. John et al. | 138/DIG. 3 |
| 3,712,073 | 1/1973 | Arenson | 62/52 |

OTHER PUBLICATIONS

The Journal of Teflon, vol. 6, No. 9, Dec. 1965.

*Primary Examiner*—Ronald C. Capossela
*Attorney, Agent, or Firm*—Michael Ebert

[57] ABSTRACT

An evaporator adapted to convert a liquified gas, such as chlorine, into a gas, the evaporator including an enclosed vapor chamber functioning as a pressure vessel. The vapor chamber is suspended within a water chamber having a heater serving to raise the temperature of the water to a level at which heat transfer through the wall of the vapor chamber causes the liquified gas fed therein through an inlet pipe to evaporate and produce a superheated gas that is discharged through an outlet pipe. The vapor chamber is fabricated of a steel tank whose outer surface is coated with a film of tetrafluoroethylene having a thickness just sufficient to render the film impermeable to water, thereby inhibiting corrosion of the steel surface and the formation of scale thereon, the thickness of the film being insufficient to materially reduce the heat transfer characteristics of the vapor chamber.

3 Claims, 2 Drawing Figures

CORROSION-RESISTANT LIQUIFIED GAS EVAPORATOR

BACKGROUND OF INVENTION

Figure 1:
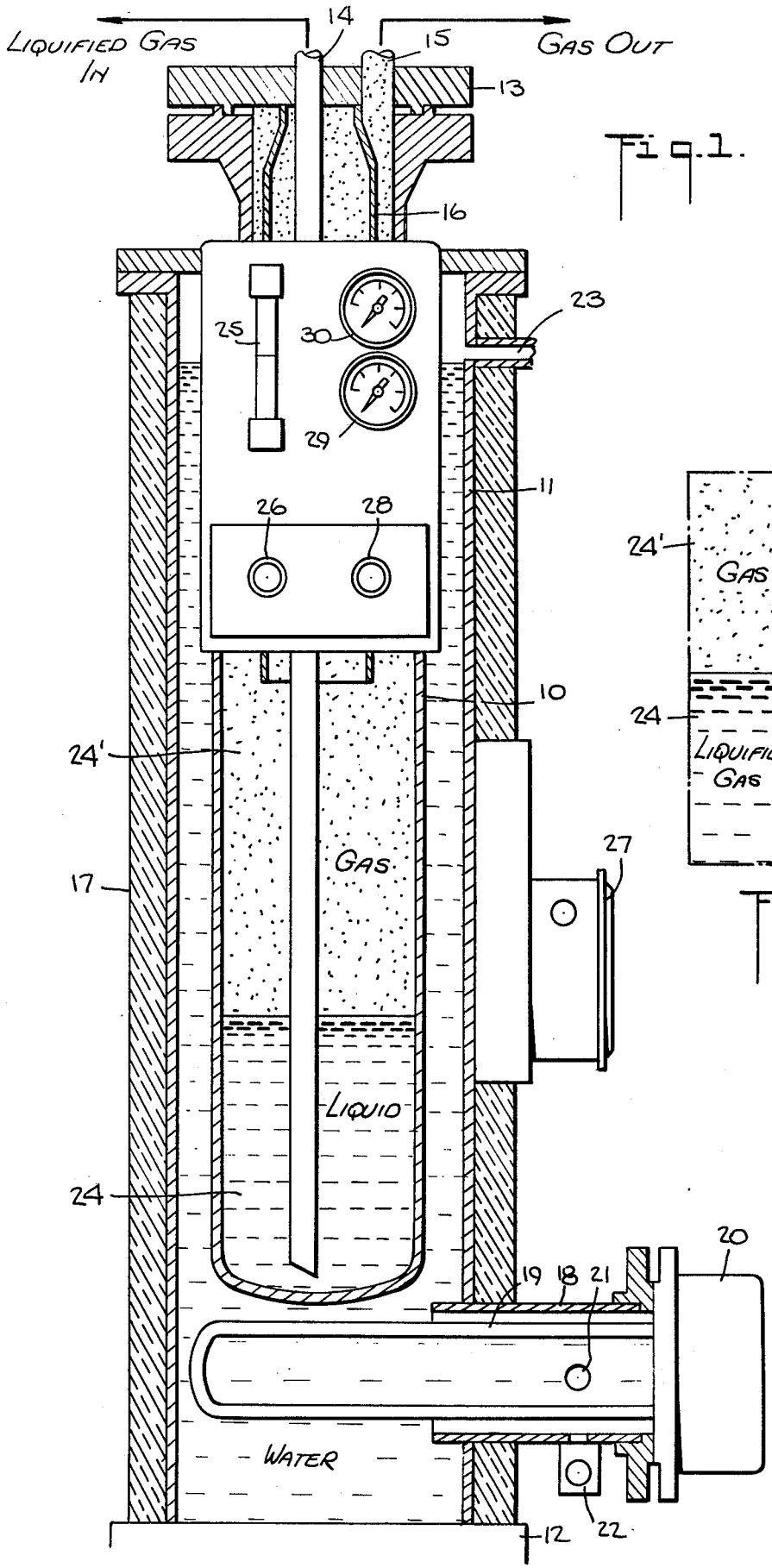

This invention relates generally to evaporators adapted to convert liquified gas into a gas, and more particularly to an evaporator chamber which is immersed in heated water, the chamber being protectively coated to inhibit corrosion and scaling without, however, degrading its heat transfer characteristics.

Though the invention is applicable to various forms of liquified gas, such as ammonia and sulphur dioxide, it will mainly be explained in connection with chlorine; for this gas, though toxic, is widely used in water purification, sewage treatment and in many industrial processes.

Chlorine evaporators of the type commercially available make use of a vapor chamber supported within a larger water chamber having an immersion heater therein. One such evaporator is manufactured by the Fischer & Porter Co. of Warminster, Pa., the device being described in their Instruction Bulletin for the Series 71V1000 Electrically Heated Evaporators.

In an evaporator of this type, water heated in the water chamber provides a uniform distribution of heat around the outer surface of the vapor chamber. As a result, liquid chlorine fed into the vapor chamber through an inlet pipe absorbs heat from the water chamber through the wall of the vapor chamber, causing the liquid chlorine to boil and converting it into a superheated gas which is discharged through an outlet pipe.

The vapor chamber which functions as a pressure vessel is generally made of carbon steel components that are welded together to define a leak-proof tank. There are two factors which are vitally important in the proper design of a vapor chamber of this type.

The first factor is the heat transfer characteristics of the vapor chamber, for it is essential that heat from the water in the water chamber be transferred without significant energy losses to the liquified gas. Carbon steel has excellent heat transfer characteristics, but because the chamber formed of this metal is immersed in water which normally contains dissolved oxygen, it is subject to fairly rapid corrosion and pitting caused by oxidation of the metal surface in contact with the water. Such corrosion degrades the heat transfer characteristics of the vapor chamber and may also affect its integrity. Moreover, the required high operating temperature accelerates the rate of corrosion.

The second factor is chlorine leakage. While highly beneficial as a hygienic agent, chlorine is hazardous as a free gas and serious injury may result to personnel in the vicinity of the evaporator by as little as 40 to 60 parts per million of chlorine gas in air inhaled for 30 minutes or more.

With a view to reducing the rate of corrosion, it is the current practice to provide cathodic protection. In the Series 71V1000 Evaporators, this is accomplished by suspending four sacrificial anode rods of magnesium in the water chamber surrounding the vapor chamber. These rods are the active elements of the protective circuit which operates on the electrochemical principle based on the flow of current between two dissimilar metals immersed in a conductive fluid. The current which flows from the more active magnesium anode to the less active cathodic carbon steel chamber surface is directed through a potentiometer and an ammeter to provide manual adjustment and visual indication of the magnitude of the protective circuit.

Cathodic protection is expensive both to install and to maintain, for the consumable anodes having a high replacement cost. Yet such protection is not fully effective, for the conditions which give rise to corrosion are many and varied, and even though a reduced electrochemical potential is created by the sacrificial anodes, an electrochemical potential can still exist to induce corrosive activity. Though the geometry of the anodes to the cathode is a controlling factor, it is impractical to place the anodes in the optimum position surrounding the vapor chamber, as a result of which some regions of the chamber are better protected than others.

Highly localized potentials can exist on the surface of the vapor chamber as a result of impurities and alloys present in the steel. Thus an intergranular electrochemical cell could be established between an iron and carbide grain structure. Since the water bath is not an ideal electrolyte, both of the above conditions are promoted. All of these conditions are highly variable, and some units therefore are more prone to corrosion than others despite carefully regulated cathodic protection.

Moreover, even if it works perfectly, the cathodic protection system affords no immunity whatever against scale build-up of a non-corrosive nature on the outer surface of the vapor chamber. This scale develops as a result of water hardness; that is, the proportion of calcium carbonate or calcium sulfate in a given sample of water. These constituents precipitate out and adhere to the steel wall to produce scale thereon which behaves as an effective thermal barrier, thereby degrading the heat transfer characteristics of the vapor chamber.

Existing ASME pressure-vessel codes dictate that to accommodate the design pressure of the vapor chamber, it must be constructed with a wall thickness of at least 0.305 inches. But because of the uncertain protection afforded by the cathodic system, it is the present practice to fabricate this chamber from steel of at least ½ inch thickness for increased strength and corrosion protection.

These extra heavy steel walls result in a unit that is extremely difficult to weld, as a consequence of which a number of passes on each joint is required. To ensure the absence of any flaws, all welds must be radiographically inspected, and if a flaw is detected it must be ground out and rewelded. Because of the thickness of the weld, it is difficult and sometimes impossible to repair a faulty weld. And as there are three welds per chamber, the probability for one faulty joint is fairly high. Should it not be possible to repair the weld, the unit must be scrapped.

Thus in the case of a vapor chamber designed as a vessel for a hazardous gas under pressure and immersed in heated water, existing measures to protect the chamber from corrosion and pitting and to prevent gas leakage are not only costly but they are not consistently effective. Hence it has heretofore been the practice to construct the chamber with a heavier gauge steel than is warranted by operating pressures. Apart from the additional expenses entailed by a thicker chamber wall, the welding problems created thereby further complicate manufacturing procedures, giving rise to significant scrap losses. And despite the steps heretofore taken to inhibit corrosion and to maintain safe operating conditions, the problem of scale build-up remains unsolved. As a consequence, with continuous use the heat transfer characteristics of the vapor chamber become impaired.

SUMMARY OF INVENTION

In view of the foregoing, it is the main object of this invention to provide an improved gas evaporator in which the outer surface of the vapor chamber is protectively coated to inhibit corrosion and the formation of scale by heated water without, however, significantly degrading the heat transfer characteristics of the chamber.

More particularly, it is an object of the invention to provide a steel vapor chamber which is immersed in a heated water chamber, the outer surface of the vapor chamber being coated with a thin film of tetrafluroethylene of sufficient thickness to render it impermeable to water but no greater than that producing a temperature gradient across the coating within acceptable limits whereby corrosion of the steel surface and the formation of scale thereon is inhibited without materially reducing the heat transfer characteristics of the vapor chamber.

Among the salient advantages of the invention are the following:

1. It does away with the need for cathodic protection and the drawbacks incident thereto.
2. It makes it possible to use relatively thin gauge steel components (i.e., less than one-half inch) for fabricating the vapor chamber without danger of corrosion and the loss of integrity.
3. It renders welding operations on the thinner steel components less difficult; it reduces the possibility of flaws in the welds and the danger of chlorine leakage, and it simplifies X-ray inspection of the welds.
4. It substantially reduces the costs of constructing and maintaining the vapor chamber.

Briefly stated, in an evaporator in accordance with the invention, an enclosed vapor chamber functioning as a pressure vessel is suspended within a water chamber having a heater adapted to raise the temperature of the water to a level at which heat transfer through the wall of the vapor chamber causes the liquified gas fed therein through the inlet pipe to evaporate to produce a superheated gas that is discharged through an outlet pipe.

The vapor chamber is fabricated of steel having a thickness of less than one-half inch, the outer surface of the chamber being coated with a thin film of tetrafluoroethylene having a thickness in the range of about 4 to 6 mils that is just sufficient to render the film impermeable to water and thereby inhibit corrosion of the steel surface and the formation of scale thereon but is insufficient to significantly reduce the heat transfer characteristics of the vapor chamber.

OUTLINE OF DRAWING

Figure 2:
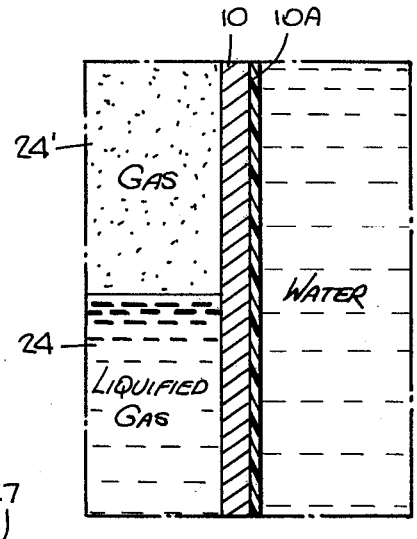

For a better understanding of the invention as well as other objects and further features thereof, reference is made to the following detailed description to be read in conjunction with the accompanying drawings, wherein:

FIG. 1 is a sectional view of an evaporator in accordance with the invention; and FIG. 2 is a section taken through the wall of the evaporator chamber.

DESCRIPTION OF INVENTION

Referring now to FIG. 1, there is shown a preferred embodiment of an electrically-operated liquified gas evaporator in accordance with the invention, the evaporator including a pressure vessel or vapor chamber 10 in the form of a cylindrical tank which is suspended concentrically within a cylindrical water chamber 11 mounted on a base plate 12. The upper end of vapor chamber 10 is provided with a cover flange 13 through which a liquified gas inlet pipe 14 extends to a point close to the bed of the chamber. Also mounted on cover flange 13 and communicating with the interior of the vapor chamber is a gas outlet pipe 15. The upper end of inlet pipe 14 is coaxially surrounded by a superheat baffle 16. Surrounding water chamber 11 is a shell 17 of thermal insulation which is preferably fiberglass batting.

Extending laterally from the wall of water chamber 11 adjacent the base thereof is a stub pipe 18 within which is received the heater elements 19 of an electrical immersion heater 20, the flange of the heater being bolted to the flange of the stub pipe. Water is supplied to pipe 18 through a water feed line 21 and is drained therefrom by a drain line 22, the water filling water chamber 11 and being heated by the immersion heater. A water vapor vent 23 is provided adjacent the top of the water chamber.

Water chamber 11 acts to uniformly distribute heat around the outer wall surface of vapor chamber 10, the shell 17 surrounding the water chamber serving to minimize radiant and convectional heat losses. Vapor chamber 10 receives the liquified gas from a supply and converts it into a gaseous state at a rate equal to the demands of the associated consuming system. Inlet pipe 14 functions to provide both forward and reverse flow of the liquified gas to and from the vapor chamber, thereby automatically regulating the level of liquified gas 24 in the chamber to increase and decrease the liquid contact area and hence the rate of evaporation in keeping with the demands of the overall system.

Superheat baffle 16, which extends a short distance downward from the top of the vapor chamber, forces evaporated gas 24' to travel along the hot wall of the chamber to outlet pipe 15, thereby superheating this gas; i.e., increasing its heat content—as sensible heat—at the existing pressure within the chamber prior to its discharge.

A water-level gauge 25 mounted on the front panel of the unit provides a visual indication of the water level in water chamber 10. A water-temperature control thermostat 26 on the front panel is manually adjustable to any desired temperature setting, so as to automatically control the temperature of the water in the water chamber. Thermostat 26 acts via the coil of a magnetic heater contactor 27 to energize and de-energize the immersion heater 20 so as to maintain the water temperature in the water chamber at the set level.

A water low-temperature switch 28, which is thermostatically operated and manually adjustable to any temperature setting, acts to sense the minimum desirable temperature and to produce a contact opening when the present value is reached, thereby serving to de-energize an electrically-operated pressure reducing and shut-off valve (not shown) in the gas discharge line 15 in the event the water temperature falls below the preset limit. Also provided is a gas temperature gauge 29 and a gas pressure gauge 30.

Vapor chamber 11 is fabricated from carbon steel components having a wall thickness which affords adequate strength to comply with existing standards for a pressure vessel. Inasmuch as the outer surface of the wall is protectively coated with a film 10A of tetrafluoroethylene (TFE) which renders this surface highly resistent to corrosion and to scaling, no need exists, as in prior arrangements, to take the possible effects of corrosion into account and to provide a wall of excessive thickness, with all of its attendant problems. Hence in practice, the steel wall may have a thickness of less than ½ inch, thereby obviating welding problems and substantially reducing the cost of the vapor chamber.

The formation of a TFE film on the outer surface of the steel wall would, at first blush, appear to impart to this wall characteristics antithetical to its basic requirements; for though the wall must efficiently transfer heat from the water chamber to the interior of the vapor chamber, TFE has a heat transfer coefficient for pure conduction of $15.77 \times 10^{-4}$ cal./sec-in-°C., hence it is a relatively poor heat conductor.

On the other hand, an extremely thin TFE coating, though it will not act as a significant thermal barrier and will therefore have no adverse effect on the heat transfer characteristics of the vapor chamber, will fail to afford protection against corrosion; for extremely thin films of TFE have some degree of porosity and will permit the water to penetrate the film. Thus the crucial feature of the present invention lies in a film of TFE that is sufficiently thick to render it impermeable to water as to protect the outer surface of the vapor chamber from corrosion and yet not so thick as to constitute thermal insulation which materially impairs the heat transfer characteristics of the chamber.

But before setting out those values of film thickness which are effective in the context of the present invention, it would be best to first review the well known basic properties of TFE, for these properties are relevant to scaling as well as corrosion. TFE is highly resistant chemically within the limits of its thermal stability, for it is only affected by molten alkali metals and elemental fluorine at high pressures. Hence the TFE film will not react with heated water, however hard; it will protectively isolate the steel from reaction with the water. As to its thermal stability, TFE is not affected by temperatures up to 500° F., which is considerably higher than the water temperature.

The coefficient of friction of TFE is extremely low, and few materials will stick to its slippery surface. Hence while in the presence of hard water, a scale build-up will take place on the surface of an uncoated steel wall, thereby impairing its heat-transfer characteristics, when the steel wall is protectively coated with a TFE film, virtually no scale will build-up on the film.

The preferred technique for forming the TFE film is by powder coating, making use of Teflon-PFA sprayable powder produced by the DuPont Company. Teflon-PFA sprayable powder is available as a free flowing powder in an unpigmented form and exhibits melt flow when heated above the melting range of 590° F. Because of its high-melt viscosity, sintering is not instantaneous, and it requires a dwell time above the critical temperature to permit flow of the powder particles and the formation of the coalesced film.

The PFA powder is applied to the cold steel substrate using standard electrostatic powder spray equipment. To obtain optimum adhesion of the powder to the substrate, use may be made of an appropriate primer, such as those disclosed in the *DuPont TEFLON FINISHES Bullentin* #1. Adhesion is also obtainable by roughening or grit-blasting the substrate prior to coating.

It has been found that with very thin TFE film produced in the above manner—i.e., films in the 1 to 3 mil range—that pinholes are inevitably present therein which render this film ineffective as a water barrier. But with a powder-coated film of at least 4 mils in thickness the film is then effectively impermeable to water and will prevent corrosion of the underlying steel.

On the other hand, when the thickness of the film exceeds about 6 mils, this results in a significant temperature drop across the film at maximum transfer rates at 15° C. We have found that by coating the outer surface of the steel vapor chamber with a TFE film of no less than 4 mils and no more than about 6 mils in thickness, this film is impenetrable by the heated water and protects the steel substrate from corrosion and scaling without, however, materially degrading the heat transfer characteristics of the chamber.

Thus by fabricating a vapor chamber of steel components having a wall thickness of less than one-half inch and by coating the outer surface of this chamber with a TFE film whose thickness lies in the range of about 4 to 6 mils, the resultant pressure vessel is of adequate strength for its intended purpose, it functions efficiently to transfer heat to the liquified gas from the water surrounding the vapor chamber and it is free from deleterious corrosion and scaling.

While there has been shown and described a preferred embodiment of a liquified gas evaporator in accordance with the invention, it will be appreciated that many changes and modifications may be made therein without, however, departing from the essential spirit thereof.

We claim:

1. An evaporator for vaporizing a liquified gas such as chlorine, said evaporator comprising:

A. a water vessel having a heater therein to raise the temperature of the water to a degree sufficient to effect vaporization of liquified gas;

B. a vapor tank supported within said vessel and surrounded by said heated water, said tank having a steel wall possessing high heat transfer characteristics;

C. means to supply the liquified gas into the tank to be vaporized by heat transferred from the water through the steel wall, said steel wall having an outer surface coated by a layer of sintered tetrafluoroethylene powders that adhere to the surface, said layer having a thickness in the range of 4 to 6 mils just sufficient to render it impermeable to the water but insufficient to materially reduce the heat transfer characteristics of the steel wall, thereby inhibiting corrosion of the outer surface and the formation of scales thereon without the loss of heat energy.

2. A vapor chamber as set forth in claim 1, wherein said tank is made of carbon steel.

3. A vapor chamber as set forth in claim 1, wherein said steel has a thickness of less than one-half inch.

* * * * *